US005727892A

United States Patent [19]

Baudin

[11] Patent Number: 5,727,892

[45] Date of Patent: Mar. 17, 1998

[54] DEVICE FOR PACKAGING AND DISPENSING A LIQUID OR A PASTE, AND HAVING A DOME-SHAPED APPLICATOR

[75] Inventor: Gilles Baudin, Eragny, France

[73] Assignee: L'Oreal, Paris, France

[21] Appl. No.: 675,870

[22] Filed: Jul. 5, 1996

[30] Foreign Application Priority Data

Jul. 12, 1995 [FR] France ..... 95 08433

[51] Int. Cl.[6] ..... A45D 40/00

[52] U.S. Cl. ..... 401/263; 401/186; 401/262; 222/494

[58] Field of Search ..... 401/186, 262, 401/263; 222/494

[56] References Cited

U.S. PATENT DOCUMENTS 2,283,463 5/1942 Rupp ..... 401/263
3,618,825 11/1971 Clarke .

FOREIGN PATENT DOCUMENTS 2305361 11/1976 France ..... 222/494
447 237 7/1927 Germany .

*Primary Examiner*—Steven A. Bratlie
*Attorney, Agent, or Firm*—Oliff & Berridge, P.L.C.

[57] ABSTRACT

A device for applying and packaging a substance in the form of a liquid or a paste, such as a cosmetic, comprises a reservoir and a dome-shaped applicator communicating internally with the reservoir and provided with outlet orifices for the substance to be dispensed. The applicator comprises an inner wall of rigid or semi-rigid plastic material fixed to the reservoir, and pierced by feed orifices, an outer membrane supported by the inner wall and having dispensing orifices in alignment with the feed orifices, but of smaller substance-passing section; and also internal closure studs for closing the dispensing orifices and located with clearance inside the feed orifices, the membrane also being capable of moving resiliently away from the closure studs under the effect of dispensing pressure in the substance so as to enable the substance to be move out from the applicator.

10 Claims, 4 Drawing Sheets

DEVICE FOR PACKAGING AND DISPENSING A LIQUID OR A PASTE, AND HAVING A DOME-SHAPED APPLICATOR

The present invention relates to a device for packaging and dispensing a substance in the form of a liquid or a paste, such as a cosmetic, the device comprising both a reservoir suitable for containing the substance and suitable for being put under pressure so as to dispense the substance, and a dome-shaped applicator for applying the substance to a large surface such as the skin, the applicator communicating internally with the reservoir and being provided with outlet orifices for the substance to be dispensed. The substance is caused to flow through the orifices by being put under pressure upstream therefrom.

BACKGROUND OF THE INVENTION

With known devices of that type, it is necessary after each use to replace a closure lid on the applicator for the purpose of isolating the outlet orifices from ambient air and preventing the substance from drying or deteriorating.

OBJECTS AND SUMMARY OF THE INVENTION

An object of the present invention is to provide a novel device that is easier to use and that makes it possible, in particular, to avoid having to replace a closure lid on the applicator every time and immediately after the substance has been applied, while nevertheless ensuring that the substance is properly conserved.

The invention achieves this object by the fact that the dome-shaped applicator comprises an inner wall of rigid or semi-rigid plastic material, fixed to the reservoir, and pierced by feed orifices, an outer membrane supported by the inner wall and having dispensing orifices in alignment with the feed orifices, but of smaller flow section for the substance, and also internally-located closure studs for closing the dispensing orifices, the studs being placed to leave clearance inside the feed orifices and serving to close the dispensing orifices in the absence of the substance being put under pressure for dispensing purposes, the membrane being capable of moving resiliently away from the closure studs under the effect of dispensing pressure in the substance so as to allow the substance to be dispensed from the applicator.

In a particular embodiment of the invention, the closure studs are carried by a supporting structure integrally molded with the inner wall. In a variant, the closure studs are carried by a supporting structure made independently from the inner wall and suitable for fixing thereto by snap-fastening.

Advantageously, the supporting structure is connected to the inner wall by a film hinge, and the closure studs are put into place in the applicator by pivoting the supporting structure about the hinge axis of the film hinge, after molding has been completed.

In a particular embodiment of the invention, the supporting structure and the inner wall are shaped so as to snap-fasten together at the end of the pivoting movement of the supporting structure.

In a particular embodiment of the invention, the closure studs are carried by supporting tabs having substantially the same shape as the inside face of the inner wall, and the inner wall includes pairs of claws organized so as to retain the supporting tabs after they have snap-fastened to the inner wall, with retention being by co-operation between complementary shapes.

In a variant, the closure studs are carried by supporting arches of substantially the same shape as the inside face of the inner wall, and recesses are formed in the inner wall to receive snap-fastening teeth formed at the ends of the arches opposite to their ends connected to the film hinge.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

FIGS. 1 to 9 show a packaging and dispensing device 1 constituting a first embodiment of the invention.

Figure 2:
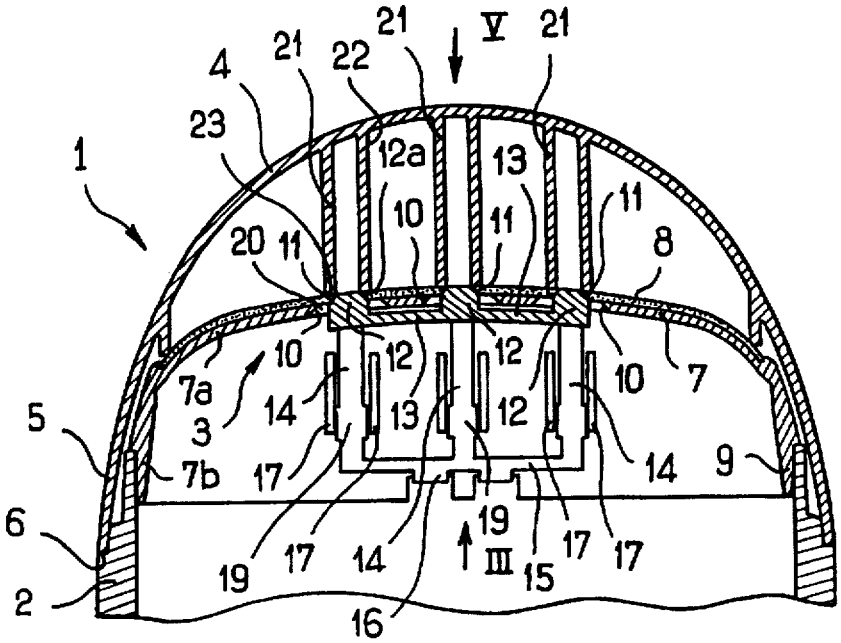
FIG. 2 is a view on section line II—II of FIG. 1.
Figure 1:
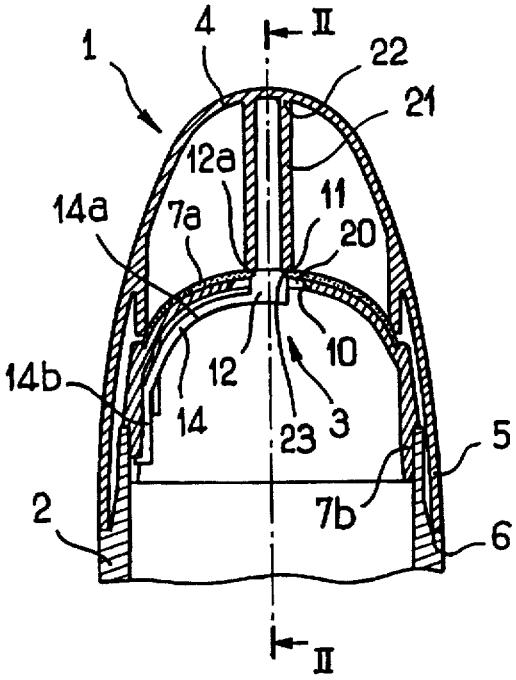
FIG. 1 is a diagrammatic and fragmentary axial section through a packaging and dispensing device comprising a first embodiment of the invention.

This device comprises a reservoir wall 2 of which only the top portion is shown in FIGS. 1 and 2, and provided at its end with a dome-shaped applicator 3. A closure lid 4 may be applied to the wall of the reservoir 2, as shown in FIGS. 1 and 2, for the purpose of covering the applicator 3. The lid 4 has a tubular skirt 5 suitable for engaging the wall of the reservoir 2 so as to bring the edge of the skirt into end abutment against a peripheral shoulder 6 of the wall 2.

The applicator 3 has an inner wall 7 of rigid or semi-rigid plastics material supporting an outer membrane 8 of elastomer plastics material. The supporting wall 7 is fixed at its periphery at 9 to the wall of the reservoir 2 by heat sealing, adhesive, or snap-fastening. The outer membrane 8 may be heat sealed or stuck by adhesive to the supporting wall 7 or it may be overmolded thereon. The membrane 8 is preferably made together with the inner wall 7 by dual-injection molding. Advantageously, the membrane 8 is made of a material giving the user a soft touch feel. For example the membrane may be made out of "Santoprene" or any other thermoplastic elastomer.

The supporting wall 7 comprises a combination of a bulging portion 7*a* that is convex towards the outside, i.e. upwards in FIGS. 1 and 2, that serves as a support for the membrane 8, and a tubular skirt 7*b* that serves for fixing to the wall of the reservoir 2 and that extends the periphery of the bulging portion 7*a* downwards.

The bulging portion 7*a* is generally in the form of a spherical or ellipsoidal cap centered on an axis of symmetry which is parallel to the wall of the reservoir 2 in the example described.

Figure 3:
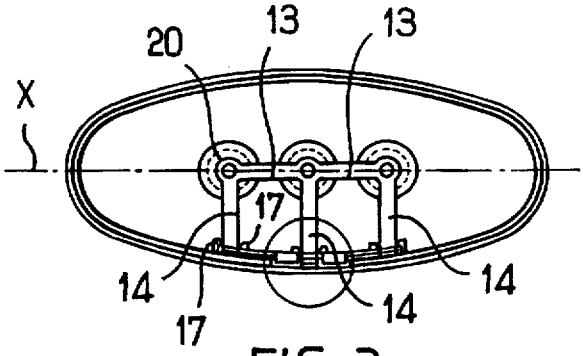
FIG. 3 is a view from beneath along arrow III of FIG. 2.
Figure 4:
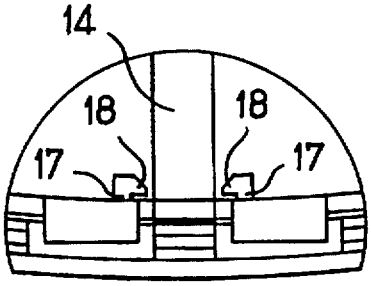
FIG. 4 is a view on a larger scale showing an implementation detail of the device shown in FIG. 3.

In projection onto a plane perpendicular to said axis of symmetry, the bulging portion in the example described is in the form of an oval that is elongate along a longitudinal axis X, as shown in FIG. 3.

In the vicinity of its top, the bulging portion 7*a* is pierced by a row of three feed orifices 10 of circular section with the axes thereof lying in a midplane containing the above-mentioned axis X. The feed orifices 10 are uniformly spaced apart with each having a section that tapers towards the outside, as can be seen in FIGS. 1 and 2. The membrane 8 is pierced by three dispensing orifices 11 that are circular, each being associated with a respective feed orifice 10 and sharing the same axis. The dispensing orifices 11 are of outwardly tapering section and their diameter, at their outer edges, is smaller than the diameter at the outer edges of the feed orifices 10, being about one-third smaller in the example described.

Closure studs 12 are disposed with clearance inside the feed orifices 10 so as to close the dispensing orifices 11 when the membrane 8 is at rest. More precisely, each closure stud 12 has a frustoconical top end 12*a* of section that tapers towards the outside. The frustoconical portions 12*a* are extended downwards by circularly cylindrical portions 12*b*. The closure studs 12 are held by a support structure comprising three supporting tabs 14 that extend transversely relative to the axis X and that are united with respective ones of the cylindrical portions 12*b*. The cylindrical portions 12*b* are connected to one another by bridges of material 13 extending along the above-mentioned axis X. The angle and the diameter at the apex of the frustoconical portions 12*a* are selected so that the closure studs 12 match the shape of the dispensing orifices 11 through the membrane 8 when the membrane is at rest, thereby closing said orifices effectively. At their ends opposite from those carrying the respective closure studs 12, the supporting tabs 14 are interconnected by a base 15, itself connected by a film hinge 16 to the tubular skirt 7*b* of the supporting wall 7. The supporting tabs 14 match the shape of the inside face of the supporting wall 7 and each of them is formed by the combination of a curved portion 14*a* extending parallel to the bulging portion 7*a* of the supporting wall 7, and by a rectilinear portion 14*b* extending over the tubular skirt 7*b*. Each supporting tab 4 is held in place inside the applicator 3 by a pair of claws 17 projecting from the inside face of the tubular skirt 7*b*. More precisely, each pair of claws 17 has facing teeth 18 for snap-fastening engagement with a shaped portion of appropriate width formed on the rectilinear portion 14*b* of the corresponding supporting tab 14.

Figure 5:
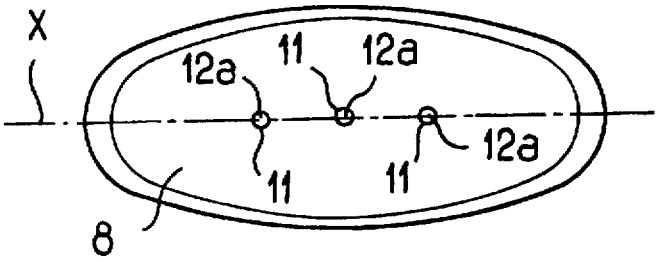
FIG. 5 is a view from above along arrow V of FIG. 2.
Figure 8:
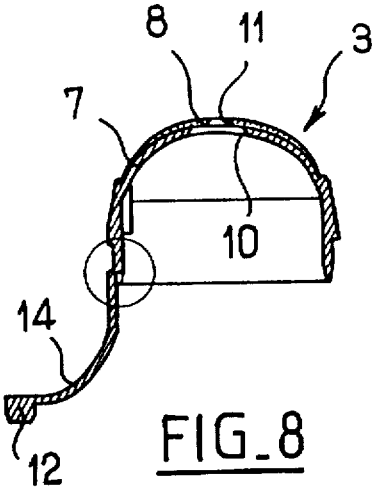
FIG. 8 is a view on section line VIII—VIII of FIG. 6.
Figure 6:
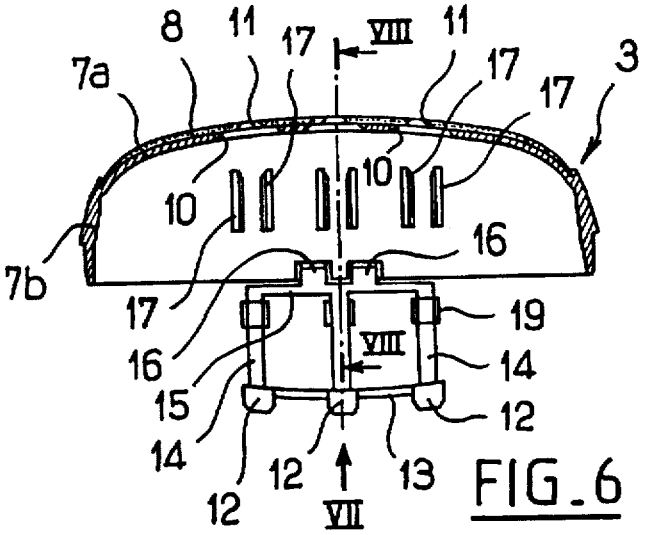
FIG. 6 is a diagrammatic axial section showing the dome-shaped applicator after molding and before being assembled on the reservoir.
Figure 9:
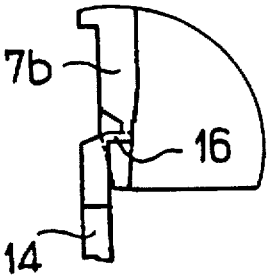
FIG. 9 shows, on a larger scale, an embodiment detail of the device shown in FIG. 8.
Figure 7:
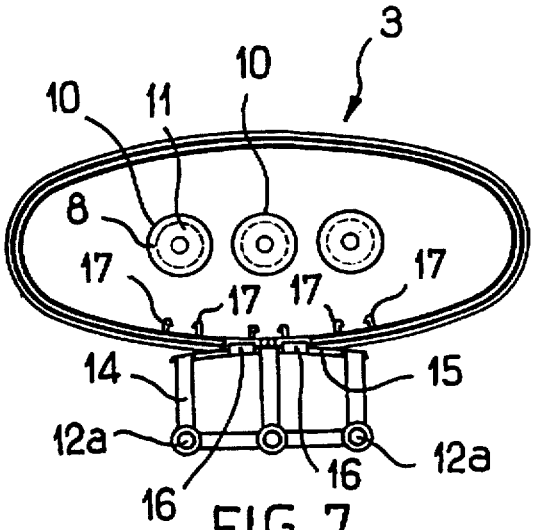
FIG. 7 is a view from below along arrow VII of FIG. 6.
Figure 11:
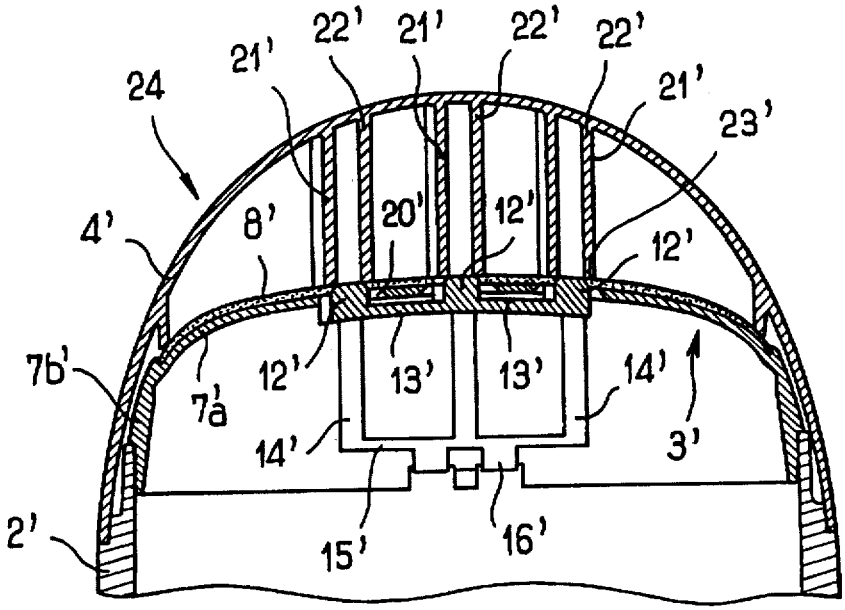
FIG. 11 is a view on section line XI—XI of FIG. 10.
Figure 10:
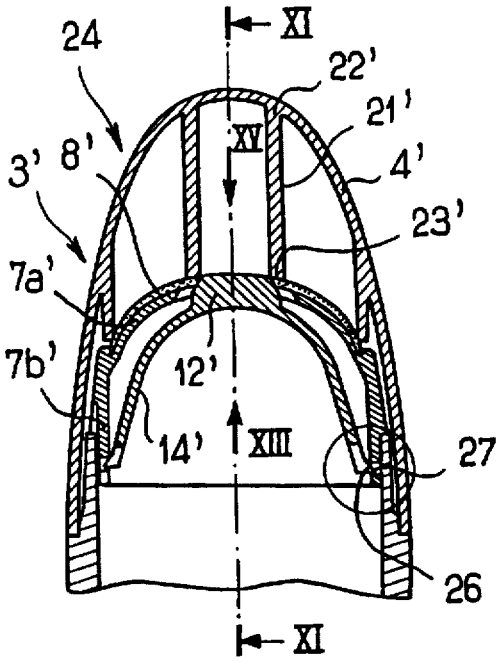
FIG. 10 is a diagrammatic and fragmentary axial section through a packaging and dispensing device constituting a second embodiment of the invention.
Figure 13:
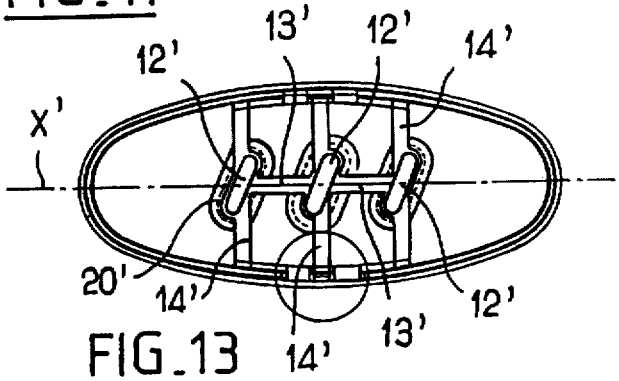
FIG. 13 is a view from below along arrow XIII of FIG. 10.
Figure 14:
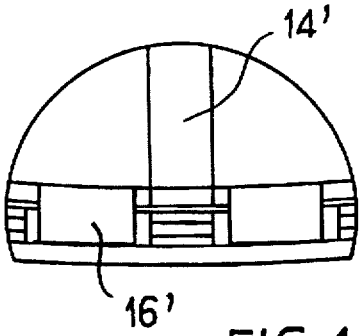
FIG. 14 shows, on a larger scale, an embodiment detail of the device shown in FIG. 13.
Figure 12:
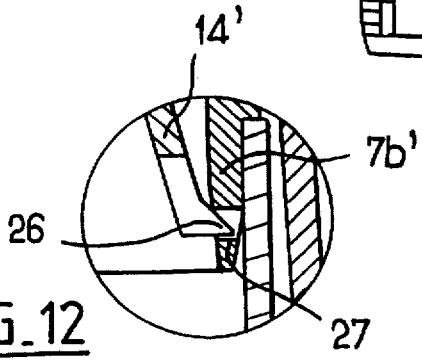
FIG. 12 shows on a larger scale an embodiment detail of the device shown in FIG. 10.
Figure 15:
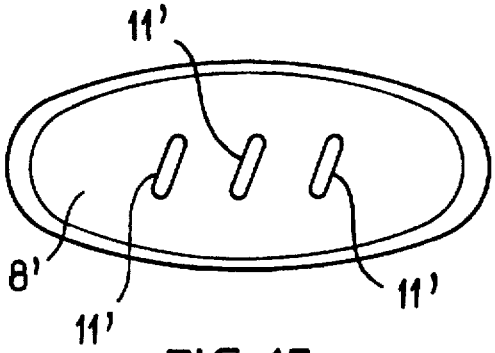
FIG. 15 is a view from above of the dome-shaped applicator shown in FIG. 10.
Figure 18:
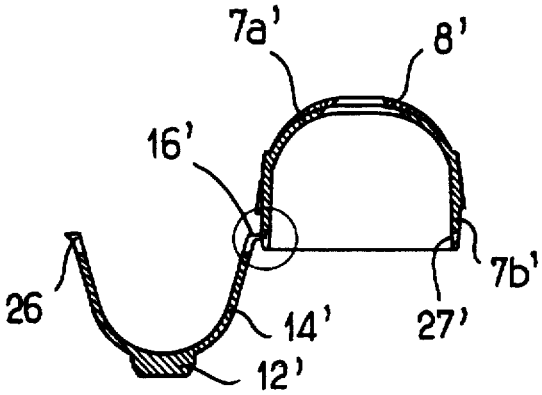
FIG. 18 is a section on section line XVIII—XVIII of FIG. 16.
Figure 16:
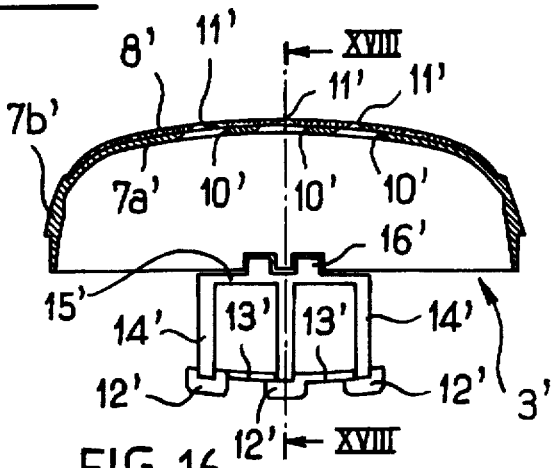
FIG. 16 is a diagrammatic axial section view of the dome-shaped applicator after it has been molded and before it has been assembled to the reservoir.
Figure 19:
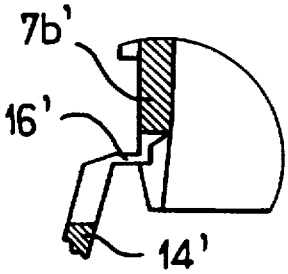
FIG. 19 shows, on a larger scale, an embodiment detail of the device shown in FIG. 18.
Figure 17:
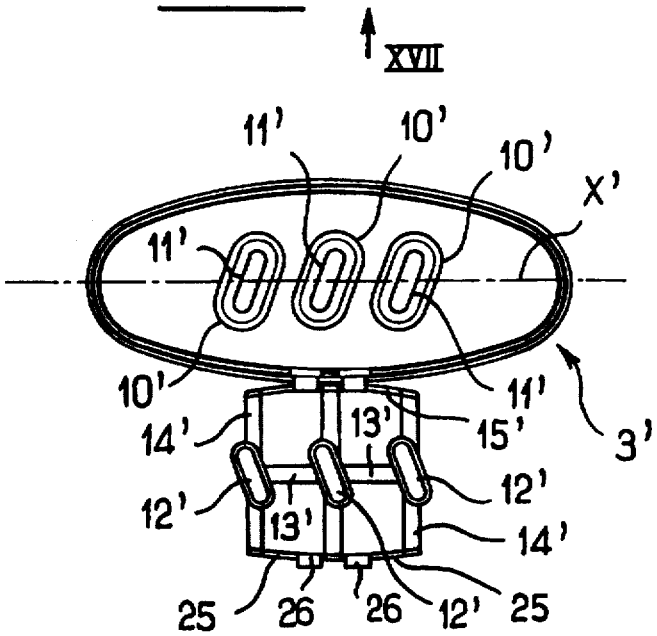
FIG. 17 is a view from beneath along arrow XVII of FIG. 16.

The plan view of FIG. 5 shows the three dispensing orifices 11 of the membrane 8 while at rest, the orifices being closed by the frustoconical top ends 12*a* of the closure studs 12.

As shown in FIGS. 6 to 9, the closure studs 12 and the supporting structure therefor are preferably integrally molded with the supporting wall 7. More precisely, the closure stud 12 and the supporting structure are molded outside the volume defined by the supporting wall 7, being connected to the end edge of the tubular skirt 7*b* by the film hinge 16, which hinge gives the supporting structure the ability to pivot about an axis of rotation parallel to the axis X.

After molding, the supporting tabs 14 are pivoted through about 180° towards the inside of the applicator and they are snapped between the claws 17. The closure studs are then engaged with clearance inside the feed orifices 10 and their frustoconical ends 12*a* fit closely in the dispensing orifices 11 of the membrane 8 at rest, thereby closing them.

Annular clearance 20 is left between the cylindrical portions 12*b* of the closure studs 12 and the edges of the feed orifices 10, as shown in FIGS. 1 to 3.

The device 1 operates as follows.

When the device is not in use, the closure studs 12 isolate the inside of the reservoir 2 from ambient air. To dispense the substance, the user applies pressure to the substance upstream from the feed orifices 10. This application of pressure may be performed by reducing the inside volume of the reservoir, e.g. by means of a known mechanism comprising a piston guided to slide relative to the wall of the reservoir 2 and displaced by rotating a screw provided with a drive knob at one end. In a variant, the wall of the reservoir 2 is flexible, and the inside volume of the reservoir is reduced by pressing in the wall of the reservoir 2. Because of its resilient properties, the membrane 8 is lifted by the pressure of the substance so as to allow the substance to be dispensed through the dispensing orifices 11 which are thereby released. The substance can flow through the annular clearance 20 and through the dispensing orifices 11 so long as it is maintained under pressure in the reservoir upstream from the feed orifices 10. When the user ceases to apply pressure to the substance, the membrane 8 returns resiliently to its initial rest position on the supporting wall 7, with the dispensing orifices 11 being closed again by the closure studs 12.

The lid 4 is shaped in such a manner as to prevent the membrane 8 from lifting to dispense substance so long as the lid is in place on the device 1. The inside of the lid 4 is provided with tubular extensions 21 that are secured at one end 22 to the top of the lid and that are shaped to have their free ends 23 bearing against the membrane 8 around the closure studs 12. The membrane 8 is thus held pressed against the closure studs 12, thereby preventing any outflow of substance through the dispensing orifices 11 even if the substance inside the reservoir should accidentally be put under pressure.

FIGS. 10 to 19 show a device 24 constituting a second embodiment of the invention.

The device 24 differs from the device described above mainly in the geometry of its feed orifices, its dispensing orifices, and its closure studs, and in the way in which the closure studs are held in place in the feed orifices. In the description below, reference numerals identical to those used for the first embodiment are used again, merely with the addition of a prime symbol ', to designate elements that are common to both embodiments (or are functionally analogous), and consequently they are not described again in detail.

The feed orifices 10' are in the form of oblong slots, with mutually parallel longitudinal axes that are inclined relative to the longitudinal axis X' of the applicator 3'.

The dispensing orifices 11' are in the form of oblong slots that are smaller in size than the feed orifices 10', having an outline that is generally similar to that of the feed orifices 10'.

The closure studs 12' are disposed in the feed orifices 10' to close the dispensing orifices 11' when the membrane 8' is at rest.

Each closure stud 12' has a top end shaped to fit the shape of the corresponding dispensing orifice 11' so as to close it effectively. The closure studs are held in place in the feed orifices 10' by a supporting structure comprising supporting arches 14'. The closure studs 12' are connected to one another by bridges of material 13' extending parallel to the axis X', and each of them is situated at the top of a corresponding supporting arch 14'. At one end the arches are connected together by a base 15' that is connected by a film hinge 16' to the tubular skirt 7b' of the supporting wall 7'. At their opposite ends, the arches 14' are connected together by bridges of material 25. Snap-fastening teeth 26 are integrally molded with the bridges of material 25 and are designed to snap into recesses 27 provided for this purpose in the tubular skirt 7b' of the supporting wall 7', as can be seen more particularly in FIG. 12.

The closure studs 12' and their pivoting supporting structure are integrally molded with the supporting wall 7.

More precisely, as shown in FIGS. 16 to 19, the arches 14' and the closure studs 12' are molded outside the inside volume defined by the supporting wall 7', and are subsequently pivoted through approximately 180° about the hinge axis of the film hinge 16' until the teeth 16 snap into the recesses 27 in the supporting wall 7'.

The device 24 operates as follows.

When the device is not in use, the membrane 8' rests on the supporting wall 7' and the dispensing orifices 11' are closed by the closure studs 12'. When the substance present in the annular clearance 20' between each closure stud 12' and the edge of the feed orifice 10' applies pressure to the inside face of the membrane 8', the membrane moves away from the supporting wall 7' to allow the substance to flow through the dispensing orifices 11'. When the substance ceases to be put under pressure for dispensing purposes, the membrane 8' comes back to press against the supporting wall 7' and the dispensing orifices 11' are closed again by the closure studs 12'.

Naturally, various modifications can be applied to the embodiments described without going beyond the ambit of the invention.

In particular, the number and the shape of the feed orifices, of the dispensing orifices, and of the closure studs can be varied.

I claim:

1. A device for applying and packaging a substance in the form of a liquid or a paste, such as a cosmetic, the device comprising both a reservoir suitable for containing said substance and suitable for being put under pressure so as to dispense said substance, and a dome-shaped applicator for applying the substance to a large surface such as the skin, the applicator communicating internally with said reservoir and being provided with outlet orifices for the substance to be dispensed, the substance being caused to flow through said orifices by being put under pressure upstream therefrom, wherein the dome-shaped applicator comprises an inner wall of rigid or semi-rigid plastic material, fixed to the reservoir, and pierced by feed orifices, an outer membrane supported by said inner wall and having dispensing orifices in alignment with said feed orifices, but of smaller flow section for the substance, and also internally-located closure studs for closing said dispensing orifices, the studs being placed to leave clearance inside the feed orifices and serving to close said dispensing orifices in the absence of said substance being put under pressure for dispensing purposes, the membrane being capable of moving resiliently away from said closure studs under the effect of dispensing pressure in said substance so as to allow said substance to be dispensed from the applicator.

2. A device according to claim 1, wherein said closure studs are carried by a supporting structure integrally molded with said inner wall.

3. A device according to claim 2, wherein said supporting structure is connected to said inner wall by a film hinge, and wherein said closure studs are put into place in the applicator by pivoting the supporting structure about the hinge axis of the film hinge, after molding has been completed.

4. A device according to claim 3, wherein said supporting structure and said inner wall are shaped so as to snap-fasten together at the end of the pivoting movement of said supporting structure.

5. A device according to claim 4, wherein said closure studs are carried by supporting tabs having substantially the same shape as the inside face of said inner wall, and wherein said inner wall includes pairs of claws organized so as to retain said supporting tabs after they have snap-fastened to the inner wall, with retention being by co-operation between complementary shapes.

6. A device according to claim 4, wherein said closure studs are carried by supporting arches of substantially the same shape as the inside face of said inner wall, and wherein recesses are formed in said inner wall to receive snap-fastening teeth formed at the ends of the arches opposite to their ends connected to said film hinge.

7. A device according to claim 1, wherein said closure studs are carried by a supporting structure made independently from the inner wall and suitable for fixing thereto by snap-fastening.

8. A device according to claim 1, including a closure lid shaped to cover said dome-shaped applicator and to hold the membrane pressed against said closure studs around said dispensing orifices in order to prevent accidental exit of the substance.

9. A device according to claim 1, wherein said outer membrane is made together with said inner wall by dual-injection molding.

10. A device according to claim 1, wherein said outer membrane is secured to said inner wall by adhesive.

* * * * *